United States Patent [19]

Shaub et al.

[11] 4,105,571

[45] Aug. 8, 1978

[54] LUBRICANT COMPOSITION

[75] Inventors: Harold Shaub, New Providence; Walter E. Waddey, Westfield, both of N.J.

[73] Assignee: Exxon Research & Engineering Co., Linden, N.J.

[21] Appl. No.: 826,544

[22] Filed: Aug. 22, 1977

[51] Int. Cl.[2] ..... C10M 1/48; C10M 3/42; C10M 5/24; C10M 7/46

[52] U.S. Cl. ..... 252/32.7 E; 252/51.5 A; 252/56 R

[58] Field of Search ..... 252/32.7 E, 56 R, 51.5 A

[56] References Cited

U.S. PATENT DOCUMENTS

| | | | |
|---|---|---|---|
| 3,180,832 | 4/1965 | Furey et al. | 252/56 R |
| 3,275,554 | 9/1966 | Wagenaar | 252/51.5 A |
| 3,281,356 | 10/1966 | Coleman | 252/32.7 E |
| 3,429,817 | 2/1969 | Furey et al. | 252/56 R |
| 3,442,808 | 5/1969 | Traise et al. | 252/49.6 |
| 3,446,737 | 5/1969 | Panzer et al. | 252/51.5 A |
| 3,522,179 | 7/1970 | Le Suer | 252/51.5 A |
| 3,562,159 | 2/1971 | Mastin | 252/32.7 E |
| 3,576,743 | 4/1971 | Widmer et al. | 252/51.5 A |
| 3,632,511 | 1/1972 | Liao | 252/51.5 A |
| 3,804,763 | 4/1974 | Meinhardt | 252/51.5 A |

*Primary Examiner*—Delbert E. Gantz
*Assistant Examiner*—Irving Vaughn
*Attorney, Agent, or Firm*—Eugene Zagarella

[57] ABSTRACT

A storage stable lubricating composition having improved anti-friction and anti-wear properties is provided by a base oil composition containing an additive combination of (1) a zinc dihydrocarbyl dithiophosphate, (2) an ester of a polycarboxylic acid and a glycol and (3) an ashless dispersant containing a high molecular weight aliphatic hydrocarbon oil solubilizing group attached thereto and wherein either the zinc or ester component or both are predispersed prior to adding them to the lubricating composition.

19 Claims, No Drawings

LUBRICANT COMPOSITION

BACKGROUND OF THE INVENTION

This invention relates to a storage stable lubricating composition containing an additive package which helps to provide particularly improved anti-friction and anti-wear properties.

There are many instances, as is well known, particularly under "Boundary Lubrication" conditions where two rubbing surfaces must be lubricated, or otherwise protected, so as to prevent wear and to insure continued movement. Moreover, where, as in most cases, friction between the two surfaces will increase the power required to effect movement and where the movement is an integral part of an energy conversion system, it is most desirable to effect the lubrication in a manner which will minimize this friction. As is also well known, both wear and friction can be reduced, with various degrees of success, through the addition of a suitable additive or combination thereof, to a natural or synthetic lubricant. Similarly, continued movement can be insured, again with varying degrees of success, through the addition of one or more appropriate additives.

While there are many known additives which may be classified as anti-wear, anti-friction and extreme pressure agents and some may in fact satisfy more than one of these functions as well as provide other useful functions, it is also known that many of these additives act in a different physical or chemical manner and often compete with one another, e.g. they may compete for the surface of the moving metal parts which are subjected to lubrication. Accordingly, extreme care must be exercised in the selection of these additives to insure compatibility and effectiveness.

The metal dihydrocarbyl dithiophosphates are one of the additives which are known to exhibit antioxidant and anti-wear properties. The most commonly used additives of this class are the zinc dialkyl dithiophosphates which are conventionally used in lubricant compositions. While such zinc compounds afford excellent oxidation resistance and exhibit superior anti-wear properties, it has heretofore been believed that the same increases or significantly limits the ability to decrease friction between moving surfaces. As a result, compositions containing zinc dialkyl dithiophosphates were not believed to provide the most desirable lubricity and, in turn, it was believed that use of compositions containing the same would lead to significant energy losses in overcoming friction even when anti-friction agents are included in the composition.

Known ways to solve the problem of energy losses due to high friction, e.g. in crankcase motor oils include the use of synthetic ester base oils which are expensive and the use of insoluble molybdenum sulfides which have the disadvantage of giving the oil composition a black or hazy appearance.

Additive mixtures of oil soluble dimer acids and polyols as disclosed in U.S. Pat. No. 3,180,832 and the esters prepared by the reaction of such components as disclosed in U.S. Pat. No. 3,429,817 exhibit good anti-wear properties as reported in said patents. The mixtures as shown in the 3,180,832 patent were also shown to have friction reducing properties. However, the use of such additives did not appear to present a practical alternative for use in conventional oils containing zinc dialkyl dithiophosphates for lubrication under boundary conditions (e.g. crankcase oils) where the prevention of wear due to heavy loading is a serious problem and the zinc dialkyl dithiophosphate is used because of its anti-wear as well as extreme pressure properties. This was based on the fact that the mixtures as taught in U.S. Pat. No. 3,180,832 were not useful in crankcase motor oils since the acid component is corrosive and interacts with the conventional zinc compound generally used for minimizing valve lifter wear and if the lower cost short chain glycols were used in order to make the mixture more commercially feasible, these shorter chain glycols would boil off under normal use conditions. Furthermore, the ester compounds as taught in U.S. Pat. No. 3,429,817 also tend to interact with the zinc dialkyl dithiophosphate and can cause such additives to eventually precipitate or drop out of the lubricant composition, i.e. it is an unstable composition.

In light of the foregoing, the need for improved lubricating compositions that will permit operation of moving parts under boundary conditions with reduced friction is believed to be readily apparent. Similarly, the need for such a composition that can include conventional base oils and other conventional additives and can be used without the loss of other desirable lubricant properties, particularly those provided by zinc dialkyl dithiophosphates, is also readily apparent.

SUMMARY OF THE INVENTION

It has now surprisingly been discovered that the foregoing and other disadvantages of the prior art lubricating additives and lubricating compositions formulated therewith can be overcome with the storage stable lubricating compositions of this invention which contain an additive combination comprising a zinc dihydrocarbyl dithiophosphate, an ester of a polycarboxylic acid and a glycol and an ashless dispersant containing a high molecular weight aliphatic hydrocarbon oil solubilizing group attached thereto.

It is then an object of this invention to provide a combination of lubricating additives including at least one zinc dihydrocarbyl dithiophosphate which will reduce friction when used in a lubricating oil composition under boundary lubrication conditions.

It is another object of this invention to provide a combination of additives including a zinc dihydrocarbyl dithiophosphate which can be used with other conventional additives and with conventional base oils to provide a lubricating composition which will exhibit acceptable anti-wear, anti-friction, extreme pressure, antioxidation and anti-corrosion properties as well as provide good storage stability. These and other objects will become apparent from the description set forth hereinafter.

In accordance with the present invention, the foregoing and other objects and advantages are accomplished with a lubricating composition containing a combination of additives comprising (1) a zinc dihydrocarbyl dithiophosphate, (2) an ester of a polycarboxylic acid and a glycol, and (3) an ashless dispersant containing a high molecular weight aliphatic hydrocarbon oil solubilizing group attached thereto and wherein either one of the zinc or ester components or both separately are predispersed in the ashless dispersant prior to adding the other of said zinc or ester components to the lubricating composition. By keeping the zinc and ester components separate until one of them is already predispersed, it has been found that resulting composition overcomes the problem of incompatability and is storage stable. Additionally and significantly, such lubrication composition has excellent anti-friction and anti-wear properties particularly under extreme pressure or heavy load conditions.

DETAILED DESCRIPTION OF THE INVENTION

The zinc dihydrocarbyl dithiophosphates useful in the present invention are salts of dihydrocarbyl esters of dithiophosphoric acids and may be represented by the following formula:

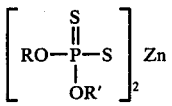

wherein R and R′ may be the same or different hydrocarbyl radicals containing from 1 to 18 and preferably 2 to 12 carbon atoms and including radicals such as alkyl, alkenyl, aryl, aralykl, alkaryl and cycloaliphatic radicals. Particularly preferred as R and R′ groups are alkyl groups of 2 to 8 carbon atoms. Thus, the radicals may, for example, be ethyl, n-propyl, i-propyl, n-butyl, i-butyl, sec-butyl, tert-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl etc. In order to obtain oil solubility, the total number of carbon atoms in the dithiophosphoric acid will average about 5 or greater.

The zinc dihydrocarbyl dithiophosphates which are useful in the compositions of the present invention may be prepared in accordance with known techniques by first esterifying a dithiophosphoric acid usually by reaction of an alcohol or phenol with $P_2S_5$ and then neutralizing the dithiophosphoric acid ester with a suitable zinc compound such as zinc oxide. In general, the alcohol or mixtures of alcohols containing from 1 to 18 carbon atoms may be used to effect the esterification. The hydrocarbon portion of the alcohol may, for example, be a straight or branched chain alkyl or alkenyl group, or a cycloaliphatic or aromatic group. Among the alcohols which are generally preferred for use as starting materials in the preparation of the esters may be mentioned ethyl, isopropyl, amyl, 2-ethylhexyl, lauryl, stearyl and methyl cyclohexyl alcohols as well as commercial mixtures of alcohols, such as the mixture of alcohols derived from coconut oil and known as "Lorol B" alcohol, which mixture consists essentially of alcohols in the $C_{10}$ to $C_{18}$ range. Other natural products containing alcohols such as the alcohols derived from wool fat, natural waxes and the like may be used. Moreover, alcohols produced by the oxidation of petroleum hydrocarbon products as well as the Oxo-alcohols produced from olefins, carbon monoxide and hydrogen may be employed. Further aromatic compounds such as alkylated phenols of the type of n-butyl phenol, tertiary-amyl phenol, diamyl phenol, tertiary octyl phenol, cetyl phenol, petroleum phenol and the like as well as the corresponding naphthols may be employed in like manner.

Following the esterification, the diester is then neutralized with a suitable basic zinc compound or a mixture of such compounds. In general, any compound could be used but the oxides, hydroxides and carbonates are most generally employed.

The oil soluble friction reducing ester component of this invention is generally derived from the esterification of a polycarboxylic acid with a glycol and will usually be a partial ester and preferably a diester having the following respective general formulas:

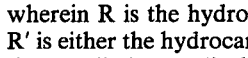

$$HO—R'—OOC—R—COOH \quad (1)$$

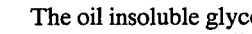

$$HO—R'—OOC—R—COOR''—OH \quad (2)$$

wherein R is the hydrocarbon radical of said acid and R′ is either the hydrocarbon radical of an alkane diol or the oxyalkylene radical from an oxa-alkane diol as defined hereinafter.

The oil insoluble glycol reacted with the polycarboxylic acid may be an alkane diol or an oxa-alkane diol, straight chain or branched. The alkane diol may have from about 2 to about 12 carbon atoms and preferably about 2 to about 5 carbon atoms in the molecule. The oxa-alkane diol can have about 4 to 200 carbon atoms with periodically repeating groups of the formula:

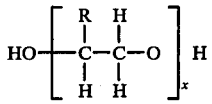

wherein R is H or $CH_3$, and $x$ is 2 to 100, preferably 2 to 25. The preferred alkane diol is ethylene glycol and the preferred oxa-alkane diol is diethylene glycol.

The polycarboxylic acid used in preparing the ester component may be an aliphatic saturated or unsaturated acid and will generally have a total of about 24 to about 90, preferably about 24 to about 60 carbon atoms and about 2 to about 3, preferably about 2 carboxylic acid groups with at least about 9 carbon atoms, preferably about 12 to about 42 and more preferably about 16 to about 22 carbon atoms between the carboxylic acid groups.

The molar quantities of the polycarboxylic acid and glycol reactants may be adjusted so as to secure either a complete ester or partial ester and generally from about 1 to about 3 or more moles of glycol is used per mole of acid and preferably from about 1 to about 2 moles of glycol per mole of acid.

It will, of course, be appreciated that esters of the type illustrated by the foregoing formulas can be obtained by esterifying a dicarboxylic acid or a mixture of such acids, with a diol, or a mixture of such diols. R would, then, be the hydrocarbon radical of the dicarboxylic acid or acids and R′ and R″ would be the hydrocarbon radical or oxyalkylene radicals associated with the diol or diols.

While any of the esters as set forth above can be effectively used, best results have been obtained with additives prepared by esterifying a dimer of a fatty acid containing conjugated unsaturation. Such compounds, are, of course, clearly taught in U.S. Pat. No. 3,429,817 which was granted on Feb. 25, 1969, and as there indicated, the hydrocarbon portion of the dimer or dicarboxylic acid thus obtained may contain a six member ring. The formation of the dimer from linoleic acid, oleic acid and mixtures of these acids is illustrated by the following:

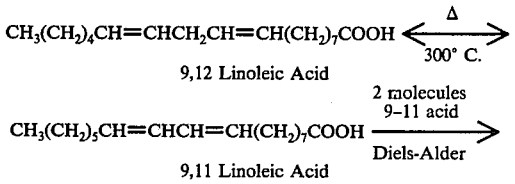

(A)

-continued

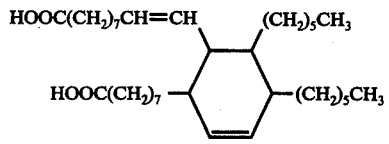

Linoleic Acid Dimer (Dilinoleic Acid)

(B)

$$CH_3(CH_2)_7CH{=}CH(CH_2)_7COOH \xrightarrow[\Delta]{\text{2 molecules oleic acid, Diels-Alder}}$$

Oleic Acid $$\begin{array}{l} CH_3(CH_2)_7CH{=}C(CH_2)_7COOH \\ \quad\quad\quad\quad\quad\quad | \\ CH_3(CH_2)_7CH_2CH(CH_2)_7COOH \end{array}$$

Oleic Acid Dimer (Dioleic Acid)

(C)

$$\text{9,11 Linoleic Acid} + \text{Oleic Acid} \xrightarrow[\Delta]{\text{Diels-Alder}}$$

$$\begin{array}{l} CH_3(CH_2)_6CHCH{=}CH(CH_2)_7COOH \\ \quad\quad\quad\quad\quad\quad | \\ CH_3(CH_2)_4CHCH{=}CHCH{=}CH(CH_2)_7COOH \end{array}$$

Mixed Dimer

It will, of course, be appreciated that while the reactions illustrated produce the illustrated dimers, commercial application of the reactions will, generally, lead to trimer formation and in some cases the product thus obtained will contain minor amounts of unreacted monomer or monomers. As a result, commercially available dimer acids may contain as much as 25% trimer and the use of such mixtures is within the scope of the present invention.

Generally, any lubricating oil ashless dispersant may be used in the lubricating composition of this invention and more preferably such dispersant will be a nitrogen containing ashless dispersant having a relatively high molecular weight aliphatic hydrocarbon oil solubilizing group attached thereto or an ester of a succinic acid/anhydride with a high molecular weight aliphatic hydrocarbon attached thereto and derived from monohydric and polyhydric alcohols, phenols and naphthols.

The nitrogen containing dispersant additives used in this invention are those known in the art as sludge dispersants for crankcase motor oils. These dispersants include mineral oil-soluble salts, amides, imides, and esters of mono- and dicarboxylic acids (and where they exist the corresponding acid anhydrides) and various amines of nitrogen containing materials having amino nitrogen or hetercyclic nitrogen and at least one amido or hydroxy group capable of salt, amide, imide or ester formation. Other nitrogen containing dispersants which may be used in this invention include those wherein a nitrogen containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

Another class of nitrogen containing dispersants which may be used are those containing Mannich bases or Mannich condensation products as they are known in the art. Such Mannich condensation products generally are prepared by condensing about 1 mole of an alkyl substituted phenol with about 1 to 2.5 moles of formaldehyde and about 0.5 to 2 moles polyalkylene polyamine as disclosed, e.g. in U.S. Pat. No. 3,442,808. Such Mannich condensation products may include a long chain, high molecular weight hydrocarbon on the phenol group or may be reacted with a compound containing such a hydrocarbon, e.g. alkenyl succinic anhydride as shown in said aforementioned 3,442,808 patent.

The nitrogen containing dispersants of this invention and the ester dispersants described hereinafter are characterized by a long chain hydrocarbon group, or groups, which may be attached, e.g. to the acid, so the acid contains a total of about 50 to about 400 carbon atoms, said acid being attached to the amine either through salt, imide, amide, or ester groups. Usually, these dispersants are made by condensing a monocarboxylic acid or a dicarboxylic acid, preferably a succinic acid producing material such as alkenyl succinic anhydride, with an amine or polyamine.

Monocarboxylic acid dispersants have been described in U.K. Patent Specification No. 983,040. Here, the high molecular weight monocarboxylic acid can be derived from a polyolefin, such as polyisobutylene, by oxidation with nitric acid or oxygen; or by addition of halogen to the polyolefin followed by hydrolyzing and oxidation. The monocarboxylic acid may also be obtained by oxidizing a monohydric alcohol with potassium permanganate, or by reacting a halogenated polyolefin with a ketone. Another method is taught in Belgian Pat. No. 658,236 where polyolefin, such as polymers of $C_2$ to $C_5$ monoolefin, e.g. polypropylene or polyisobutylene, is halogenated, e.g. chlorinated, and then condensed with an alpha, beta-unsaturated, monocarboxylic acid of from 3 to 8, preferably 3 to 4, carbon atoms, e.g. acrylic acid, alpha-methyl-acrylic acid, i.e., 2-methyl propenoic acid, crotonic, or isocrotonic acid, tiglic acid (alpha, methylacrontonic acid), angelic acid (alpha-methylisocrontonic acid), sorbic acid, cinnamic acid, etc. Esters of such acids, e.g. ethyl methacrylate, may be employed if desired in place of the free acid.

The most commonly used dicarboxylic acid is alkenyl succinic anhydride wherein the alkenyl group contains about 50 to about 400 carbon atoms.

Primarily because of its ready availability and low cost, the hydrocarbon portion of the mono- or dicarboxylic acid or other substituted group is preferably derived from a polymer of a $C_2$ to $C_5$ monoolefin, said polymer generally having a molecular weight of about 700 to about 5000. Particularly preferred is polyisobutylene.

Polyalkyleneamines are usually the amines used to make the dispersant. These polyalkyleneamines include those represented by the general formula:

$$H_2N(CH_2)_n[NH(CH_2)_n]_mNH(CH_2)_nNH_2$$

wherein $n$ is 2 or 3, and $m$ is 0 to 10. Examples of such polyalkyleneamines include diethylene triamine, tetraethylene pentamine, octaethylene nonamine, tetrapropylene pentamine, as well as various cyclic polyalkyleneamines.

Dispersants formed by reacting about equal molar amounts of polyisobutenyl succinic anhydride and a tetraethylene pentamine are described in U.S. Pat. No. 3,202,678. Similar dispersants, but made by reacting a molar amount of alkenyl succinic anhydride with about two molar amounts of polyalkyleneamines, are described in U.S. Pat. No. 3,154,560. Other dispersants, using still other molar ratios of alkenyl succinic anhydride and polyalkyleneamines are described in U.S. Pat. No. 3,172,892. Still other dispersants of alkenyl succinic anhydride with other amines are described in U.S. Pat. Nos. 3,024,195 and 3,024,237 (piperazine amines); and 3,219,666. An ester derivative is taught in Belgian Pat.

No. 662,875 where N-alkyl morpholinone esters, e.g. N-(2-hydroxyethyl)-2-morpholinone, are formed by reaction with polyisobutenyl succinic anhydride. The prior art also teaches that the alkenyl succinic polyamine type dispersants can be further modified by reacting a fatty acid, having up to 22 carbon atoms, e.g. acetic acid, with the reaction product of the alkenyl succinic anhydride and polyamine (see U.S. Pat. No. 3,216,936).

The ester containing ashless dispersants of this invention as described above are derived from hydroxy compounds which may be aliphatic compounds such as monohydric and polyhydric alcohols or aromatic compounds such as phenols and naphthols. The aromatic hydroxy compounds from which the esters of this invention may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, propene tetramer-substituted phenol, didodecylphenol, 4,4'-methylene-bis-phenol, alpha-decyl-beta-naphthol, polyisobutene (molecular weight of 1000) -substituted phenol, the condensation product of heptylphenol with 0.5 mole of formaldehyde, the condensation product of octylphenol with acetone, di(hydroxyphenyl)oxide, di(hydroxyphenyl)sulfide, di(hydroxyphenyl)disulfide, and 4-cyclohexylphenol. Phenol and alkylated phenols having up to three alkyl substituents are preferred. Each of the alkyl substituents may contain 100 or more carbon atoms.

The alcohols from which the ester dispersants may be derived preferably contain up to about 40 aliphatic carbon atoms. They may be monohydric alcohols such as methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, mono-oleate of ethylene glycol, monostearate of diethylene glycol, sec-pentyl alcohol, tert-butyl alcohol, 5-bromo-dodecanol, nitrooctadecanol and dioleate of glycerol. The polyhydric alcohols are the most preferred hydroxy compound and preferably contain from 2 to about 10 hydroxy radicals. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, trimethylol propane 9,10-dihydroxy stearic acid, methyl ether of 9,10-dihydroxy stearic acid, 1,2-butanediol, 2,3-hexanediol, 2,4-hexanediol, pinacol, erythritol, arabitol, sorbitol, mannitol, 1,2-cyclo-hexanediol, and xylylene glycol. Carbohydrates such as sugars, starches, celluloses, etc., likewise may yield the esters of this invention. The carbohydrates may be exemplified by a flucose, fructose, sucrose, rhamose, mannose, glyceraldehyde, and galactose.

An especially preferred class of polyhydric alcohols are those having at least three hydroxy radicals, some of which have been esterified with a monocarboxylic acid having from about 8 to about 30 carbon atoms such as octanoic acid, oleic acid, stearic acid, linoleic acid, dodecanoic acid, or tall oil acid. Examples of such partially esterified polyhydric alcohols are the mono-oleate of sorbitol, distearate of sorbitol, mono-oleate of glycerol, monostearate of glycerol, di-dodecanoate of erythritol.

The ester dispersant of this invention may also be derived from unsaturated alcohols such as allyl alcohol, cinnamyl alcohol, propargyl alcohol, 1-cyclohexene-3-ol, and oleyl alcohol. Still other classes of the alcohols capable of yielding the esters of this invention comprises the ether-alcohols and amino-alcohols including, for example, the oxy-alkylene-, oxy-arylene-, amino-alkylene-, and aminoarylene-substituted alcohols having one or more oxy-alkylene, amino-alkylene or amino-arylene oxy-arylene radicals. They are exemplified by Cellosolve, Carbitol, phenoxyethanol, heptylphentyl-(oxypropylene)$_6$-H, octyl-(oxyethylene)$_{30}$-H, phenyl-(oxyoctylene)$_2$-H, mono(heptylphenyloxy-propylene)-substituted glycerol, poly(styrene oxide), aminoethanol, 3-amino ethylpentanol, di(hydroxyethyl)amine, p-aminophenol, tri(hydroxypropyl)amine, N-hydroxyethyl ethylene diamine, N,N,N',N'-tetrahydroxytrimethylene diamine, and the like. For the most part, the ether-alcohols having up to about 150 oxy-alkylene radicals in which the alkylene radical contains from 1 to about 8 carbon atoms are preferred.

The ester dispersant of this invention may be di-esters of succinic acids or acidic esters, i.e., partially esterified succinic acids; as well as partially esterified polyhydric alcohols or phenols, i.e., esters having free alcoholic or phenolic hydroxyl radicals. Mixtures of the above-illustrated esters likewise are contemplated within the scope of this invention.

A suitable class of ester dispersant for use in the lubricating compositions of this invention are those diesters of succinic acid and an alcohol having up to about nine aliphatic carbon atoms and having at least one substituent selected from the class consisting of amino and carboxy groups wherein the hydrocarbon substituent of the succinic acid is a polymerized butene substituent having a molecular weight of from about 700 to about 5000.

The ester dispersant of this invention may be prepared by one of several known methods as illustrated for example in U.S. Pat. No. 3,522,179.

While any of the above type dispersants may be used in this invention, particularly preferred are those prepared with alkenyl succinic acid/anhydrides where the alkenyl radicals have a molecular weight of at least about 900 and preferably at least about 1200 and more preferably at least about 1300.

Particularly preferred nitrogen containing dispersants are those derived from amine compounds having the following formulas:

(A) alkylene polyamines

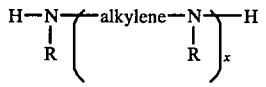

wherein $x$ is an integer of about 1 to 10, preferably about 2 to 4, R is hydrogen, a hydrocarbon or substantially a hydrocarbon group containing about 1 to 7, preferably about 1 to 4 carbon atoms and the alkylene radical is a straight or branched chain alkylene radical having up to about 7, preferably about 2 to 4 carbon atoms;

(B) polyoxyalkylene polyamines (i) $NH_2$—alkylene-(O—alkylene)$_m$-$NH_2$ where $m$ has a value of about 3 to 70 and preferably 10 to 35 and (ii) R-[alkylene-(O—alkylene)$_n$-$NH_2$]$_{3-6}$ where $n$ has a value of about 1 to 40 with the proviso that the sum of all the $n$'s is from about 3 to about 70 and preferably from about 6 to about 35 and R is a polyvalent saturated hydrocarbon radical of up to ten carbon atoms having a valence of 3 to 6. The alkylene groups in either formula (i) or (ii) may be straight or branched chains containing about 1 to 7 and preferably about 1 to 4 carbon atoms; and (C) primary amines and hydroxy substitutes thereof

R—$NH_2$ where R is a monovalent organic group having up to 20, preferably 10 carbon atoms and may contain one or more alcoholic hydroxyl groups and preferably 1 to 6 alcoholic hydroxyl groups. The R group in this formula may be an aliphatic, aromatic, heterocyclic or carbocyclic radical. An alcoholic hydroxyl group being one not attached to a carbon atom forming part of an aromatic nucleus.

The alkylene polyamines of formula (A) above, include, for example, methylene amines, ethylene amines, butylene amines, propylene amines, pentylene amines, hexylene amines, heptylene amines, octylene amines, other polymethylene amines, and the cyclic and higher homologs of these amines such as the piperazines, and the amino-alkyl-substituted piperazines. These amines, include, for example, ethylene diamine, triethylene tetramine, propylene diamine, di(heptamethylene)triamine, tripropylene tetramine, tetraethylene pentamine, trimethylene diamine, pentaethylene hexamine, di(trimethylene)triamine, 2-heptyl-3-(2-aminopropyl-)imidazoline, 4-methylimidazoline, 1,3-bis-(2-aminoethyl)imidazoline, pyrimidine, 1-(2-aminopropyl)piperazine, 1,4-bis-(2-aminoethyl)piperazine, N,N-dimethylaminopropyl amine, N,N-dioctylethyl amine, N-octyl-N'-methylethylene diamine, and 2-methyl-1-(2-aminobutyl)piperazine. Other higher homologs which may be used can be obtained by condensing two or more of the above-mentioned alkylene amines in a known manner.

The ethylene amines which are particularly useful are described, for example, in the Encyclopedia of Chemical Technology under the heading of "Ethylene Amines" (Kirk and Othmer), volume 5, pages 898–905; Interscience Publishers, New York (1950). These compounds are prepared by the reaction of an alkylene chloride with ammonia. This results in the production of a complex mixture of alkylene amines, including cyclic condensation products such as piperazines. While mixtures of these amines may be used for purposes of this invention, it is obvious that pure alkylene amines may be used with complete satisfaction. A particularly useful alkylene amine comprises a mixture of ethylene amines prepared by the reaction of ethylene chloride and ammonia which may be characterized as having a composition that corresponds to that of tetraethylene pentamine. In addition, the alkylene amines having one or more hydroxyalkyl substituents on the nitrogen atoms may be used. These hydroxy-alkyl-substituted alkylene amines are preferably compounds wherein the alkyl group is a lower alkyl group, i.e. having less than about 6 carbon atoms and include, for example, N-(2-hydroxyethyl)ethylene diamine, N,N'-bis(2-hydroxyethyl)ethylene diamine, 1-(2-hydroxyethyl)piperazine, mono-hydroxypropyl-substituted diethylene triamine, 1,4-bis(2-hydroxypropyl)-piperazine, di-hydroxy-propyl-substituted tetraethylene pentamine, N-(3-hydroxypropyl)tetramethylene diamine, 2-heptadecayl-1-(2-hydroxyethyl)imidazole, etc.

The polyoxyalkylene polyamines of formula (B) above, which may be used for this invention, e.g. polyoxyalkylene diamines and polyoxyalkylene triamines may have average molecular weights ranging from about 200 to about 4000 and preferably from about 400 to about 2000. The preferred polyoxyalkylene polyamines for purposes of this invention include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

The primary amines and hydroxy substitutes thereof, as defined by formula (C) include aliphatic amines, aromatic amines, heterocyclic or carbocyclic amines as well as the hydroxy substitutes thereof. Specific amines of this type include methylamine, cyclohexylamine, aniline, dodecylamine, 2-amino-1-butanol, 2-amino-2-methyl-1-propanol, p-($\beta$-hydroxyethyl)-aniline, 2-amino-1-propanol, 3-amino-1-propanol, 2-amino-2-methyl-1,3-propane-diol, 2-amino-2-ethyl-1,3-propanediol, N-($\beta$-hydroxy-propyl)-N'-($\beta$-aminoethyl)-piperazine, tris(hydroxymethyl)aminomethane (also known as trismethylolaminomethane), 2-amino-1-butanol, ethanolamine, $\beta$-($\beta$-hydroxyethoxy)-ethylamine, glucamine, glucosamine, 4-amino-3-hydroxy-3-methyl-1-butene (which can be prepared according to procedures known in the art by reacting isopreneoxide with ammonia), N-(3-aminopropyl)-4-(2-hydroxyethyl)-piperidine, 2-amino-6-methyl-6-heptanol, 5-amino-1-pentanol, N-($\beta$-hydroxyethyl)-1,3-diamino propane, 1,3-diamino-2-hydroxy-propane, N-($\beta$-hydroxyethyl)-ethylene diamine, and the like. Mixtures of these or similar amines can also be employed.

Particularly preferred amine derived dispersants of the above described types are those derived from about 0.3:1 to about 20:1, preferably about 1:1 to about 10:1 and more preferably from about 2:1 to about 10:1 moles of alkenyl succinic acid/anhydride to amine. It is also particularly preferred that the nitrogen content of the prepared amine derived dispersant be less than about 2 percent by weight and preferably less than 1.5 percent. The preferred dispersants are those derived from polyisobutenyl succinic anhydride and polyethylene amines, e.g. tetraethylene pentamine, polyoxyethylene and polyoxypropylene amines, e.g. polyoxypropylene diamine, trismethylolaminomethane and pentaerythritol and combinations thereof. One particularly preferred dispersant combination involves a combination of (A) polyisobutenyl succinic anhydride with (B) a hydroxy compound, e.g. pentaerythritol, (C) a polyoxyalkylene polyamine, e.g. polyoxypropylene diamine, and (D) a polyalkylene polyamine, e.g. polyethylene diamine and tetraethylene pentamine using about 0.01 to about 4 equivalents of (B) and (D) and about 0.01 to about 2 equivalents of (C) per equivalent of (A) as described in U.S. Pat. No. 3,804,763. Another preferred dispersant combination involves the combination of (A) polyisobutenyl succinic anhydride with (B) a polyalkylene polyamine, e.g. tetraethylene pentamine, and (C) a polyhydric alcohol or polyhydroxy-substituted aliphatic primary amine, e.g. pentaerythritol or trismethylolaminomethane as described in U.S. Pat. No. 3,632,511.

To further enhance the dispersancy, the alkenyl succinic polyamine type dispersants can be further modified with a boron compound such as boron oxide, boron halides, boron acids and ester of boron acids in an amount to provide about 0.1 to about 10 atomic proportions of boron per mole of the acylated nitrogen compound as generally taught in U.S. Pat. Nos. 3,087,936 and 3,254,025.

The above described additive package may be used in conventional base oils and with other conventional additives. However, it is an important feature of this invention that in order to have a storage stable composition which will retain the exceptional anti-friction and anti-wear properties, the zinc dihydrocarbyl dithiophosphate and the polycarboxylic acid/glycol ester components must be maintained apart from one another until at least one of such components has been predispersed. By predispersed it is meant that the ester component or the zinc component is separately mixed with the ashless dispersant, which may be in oil solution, until the solution is generally clear and fully miscible. This mixing process may be accelerated by heating the solution to a temperature of up to about 75° C. If this procedure is not followed, over a period of time the zinc component will tend to react or complex with the ester causing it to precipitate or drop out of solution and therefore the composition is unstable and loses its favorable properties. To overcome this problem, either the zinc dihydrocarbyl dithiophosphate or the dicarboxylic acid/glycol ester is separately dispersed prior to combining it with the other said component in the lubricating composition and of course if desired, both components may be separately predispersed. It is to be noted that the other additives may be added in their normal and conventional manner, with the only requirement being that the zinc and ester components are not combined in the composition or any part thereof until at least one of them has been predispersed.

In general, the zinc dihydrocarbyl dithiophosphate will be used in the lubricating composition at a concentration within the range of about 0.01 to about 5 parts by weight per 100 parts of lubricating oil and preferably from about 0.5 to about 1.5. The polycarboxylic acid/glycol ester will be used at a concentration of about 0.01 to about 1.0, preferably about 0.05 to about 0.3 and more preferably about 0.05 to about 2 parts by weight per parts of lubricating oil and the alkenyl succinic acid/anhydride ashless dispersant will be employed at a concentration of about 0.1 to about 30, preferably about 0.5 to about 10 parts by weight per 100 parts of lubricating oil.

The lubricating oil liquid hydrocarbons which may be used include the mineral lubricating oils and the synthetic lubricating oils and mixtures thereof. The synthetic oils will include diester oils such as di(2-ethylhexyl) sebacate, azelate and adipate; complex ester oils such as those formed from dicarboxylic acids, glycols and either monobasic acids or monohydric alcohols; silicone oils; sulfide esters; organic carbonates; and other synthetic oils known to the art.

Other additives, of course, may be added to the oil compositions of the present invention to form a finished oil. Such additives may be the conventionally used additives including oxidation inhibitors such as phenothiazine or phenyl $\alpha$-naphthylamine; rust inhibitors such as lecithin or sorbitan monoleate; detergents such as the barium phenates; pour point depressants such as copolymers of vinyl acetate with fumaric acid esters of coconut oil alcohols; viscosity index improvers such as olefin copolymers, polymethacrylates; etc. A particularly useful additive is the basic alkaline earth metal salts of an organic sulfonic acid, generally a petroleum sulfonic acid or a synthetically prepared alkaryl sulfonic acid. Among the petroleum sulfonates, the most useful products are those prepared by the sulfonation of suitable petroleum fractions with subsequent removal of acid sludge and purification. Synthetic alkaryl sulfonic acids are usually prepared from alkylated benzenes such as the Friedel-Crafts reaction product of benzene and a polymer such as tetrapropylene. Suitable acids may also be obtained by sulfonation of alkylated derivatives of such compounds as diphenylene oxide thianthrene, phenolthioxine, diphenylene sulfide, phenothiazine, diphenyl oxide, diphenyl sulfide, diphenylamine, cyclohexane, decahydro naphthalene and the like.

Basic alkaline earth metal sulfonates are generally prepared by reacting an alkaline earth metal base, e.g. lime, magnesium oxide, magnesium alcoholate with $CO_2$ in the presence of sulfonic acid or neutral metal sulfonates, ordinarily the calcium, magnesium or barium salts. These neutral salts in turn may be prepared from the free acids by reaction with the suitable alkaline earth metal base, or by double decomposition of an alkali metal sulfonate, which methods are well known in the art. Further details are described in U.S. Pat. No. 3,562,159.

As previously indicated, the additive combination of the present invention can be used with other additives and, indeed, such additives will generally be used in fully formulated lubricating compositions. Since the zinc dihydrocarbyl dithiophosphates and the polycarboxylic acid/glycol esters used in the present invention tend to compete with similar additives which function by bonding with the metal surfaces, it is preferred that the concentration of such additives in fully formulated compositions be maintained at relatively low values.

The following examples are further illustrative of this invention and are not intended to be construed as limitations thereof.

EXAMPLE I

Several formulations were prepared using a 10W-40SE quality automotive engine oil containing 1.5% by weight based on the total lubricating oil weight of zinc dialkyl dithiophosphate (80% active ingredient in diluent mineral oil) in which the alkyl groups were a mixture of such group having between about 4 and 5 carbon atoms and made by reacting $P_2S_5$ with a mixture of about 65% isobutyl alcohol and 35% of amyl alcohol; 0.1% by weight, based on the total lubricating oil weight, of an ester formed by the esterification of a dimer acid of linoleic acid and diethylene glycol and having the formula:

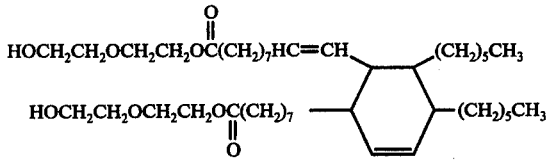

Various dispersants were used in the different lubricating formulations as described below:

(A) An ashless dispersant was prepared by reacting polyisobutenyl succinic anhydride (PIBSA), the polyisobutenyl radical (PIB) having an average molecular weight ($\overline{M}n$) of about 900, with an equal molar amount of pentaerythritol and a minor amount of a polyamine mixture comprising polyoxypropylene amine and polyethylene amines to form a product having a nitrogen content of about 0.35% by weight. Materials of this type are described in U.S. Pat. No. 3,804,763 and sold by Lubrizol Corporation under the tradename Lubrizol 6401.

(B) A borated ashless dispersant was prepared by condensing 2.1 moles of polyisobutenyl succinic anhydride, the polyisobutenyl radical having an average molecular weight of about 1300, dissolved in Solvent Neutral 150 mineral oil to provide a 50 wt. % solution with 1 mole of tetraethylene pentamine. The polyisobutenyl succinic anhydride solution was heated to about 150° C. with stirring and the polyamine was charged into the reaction vessel over a four hour period which was thereafter followed by a three hour nitrogen strip. The temperature was maintained from about 140° C. to 165° C. during both the reaction and the subsequent stripping. While the resulting product was maintained at a temperature of from about 135° to about 165° C. a slurry of 1.4 moles of boric acid in mineral oil was added over a three-hour period which was thereafter followed by a final four-hour nitrogen strip. After filtration and rotoevaporation, the concentrate (50 wt. % of the reaction product) contained about 1.46 wt. % nitrogen and 0.32 wt. % of boron.

(C) An ashless dispersant was prepared by charging 1.0 mole of PIBSA having a PIB group with an $\overline{M}n$ of about 1300 dissolved in 500 ml of Solvent 150 Neutral, 0.36 mole of zinc acetate dihydrate as a promoter and 1.9 mole of tris(hydroxymethyl) aminomethane (THAM) into a glass reactor. Heating at about 168° to 174° C. for four hours gave the expected quantity of water. After filtration and rotoevaporation, the concentrate (50 wt. % active ingredient) analyzed for 1.0 wt. % nitrogen.

(D) An ashless dispersant was prepared in a similar manner as described in (B) above using 1.3 moles of PIBSA (PIB had $\overline{M}n$ of about 900) and boration was not undertaken. The product had a nitrogen content of 2.1% by weight.

In preparing the final lubricating oil compositions, the ester component of each composition was first dispersed in the following amounts of the above defined ashless dispersants:

(A) 5.25% by wt. of dispersant (mixture of 46.5% by wt. active ingredient in mineral lubricating oil);

(B) and (C) 5.25% by wt. of dispersant (mixture of 50% by wt. active ingredient in mineral lubricating oil);

(D) 6.3% by wt. of dispersant (mixture of 50% by wt. active ingredient in mineral lubricating oil).

The ester portion of each composition as described above (0.1% by wt.) was dispersed in the above defined dispersants at about 65° C. and stirred for 2 hours and then added to a solution of a standard lubricating composition of 10W-40SE crankcase oil which contained a rust inhibitor, i.e. overbased magnesium sulfonate, a detergent, a V.I. improver, i.e. an ethylene-propylene copolymer, and the aforementioned zinc dialkyl dithiophosphate (1.5% by wt. - 80% active ingredient in mineral oil).

As contrasted to compositions wherein the zinc dialkyl dithiophosphate was added to the dicarboxylic acid/glycol ester prior to predispersing either one, all of the above exhibited storage stability over an extended period of several months at ambient temperature. The formulation containing dispersant D did show signs of somewhat poor storage stability as evidenced by additive dropout after two weeks at ambient temperature indicating that an increased amount of this type dispersant was necessary to maintain the compatability of the system.

EXAMPLE II

In this example, two compositions prepared as described in Example I and containing a zinc dialkyl dithiophosphate and a dicarboxylic acid/glycol ester were tested for relative friction and wear using a ball on cylinder test. For comparison a standard 10W-40SE quality automotive engine oil containing only the zinc component was also tested for relative friction and wear.

The apparatus used in the ball on cylinder test is described in the Journal of the American Society of Lubrication Engineers, entitled "ASLE Transactions", Vol. 4, pages 1–11, 1961. In essence, the apparatus consists basically of a fixed metal ball loaded against a rotating cylinder. The weight on the ball and the rotation of the cylinder can be varied during any given test or from test to test. Also, the time of any given test can be varied. Generally, however, steel on steel is used at a constant load, a constant rpm and a fixed time and in each of the tests of this example, a 4Kg load, 0.26 rpm and 70 minutes was used. The actual wear was determined by measuring the volume of metal removed from the cylinder and then placed on a relative basis by ratioing the wear actually obtained against a standard. The actual friction, on the other hand, was determined from the power actually required to effect rotation and the relative friction determined by ratioing the actual load to that of a standard. The apparatus and method used is more fully described in U.S. Pat. No. 3,129,580 which was issued May 21, 1964 to Furey et al and which is entitled "Apparatus For Measuring Friction and Contacts Between Sliding Lubricating Surfaces".

(I) In the first composition, a standard 10W-40SE lubricating oil composition, the same as defined in Example I containing dispersant D and 1.5% by weight of zinc dialkyl dithiophosphate (80% active ingredient in mineral oil) and the other standard additives including a rust inhibitor, a detergent, a V.I. improver, but without the dicarboxylic acid/glycol ester was blended together.

(II) In this composition, the ester component as defined in Example I was predispersed in ashless dispersent D (described in Example I) and then combined with the standard lubricating composition containing additives, including the zinc dialkyl dithiophosphate as also described in Example I.

(III) In this composition, the ester component was predispersed in ashless dispersant A and then combined with the standard lubricating composition containing additives including the zinc dialkyl dithiophosphate as fully described in Example I.

The following tables show the resulting relative friction and wear data for the three compositions, with composition I (without ester) being assigned relative values of 1.00:

| | Relative Ball/Cylinder Data | |
|---|---|---|
| | Friction | Wear |
| Composition I | 1.00 | 1.00 |
| Composition II | 0.59 | 0.62 |
| Composition III | 0.62 | 0.48 |

Besides the improved friction and wear properties exhibited in a lubricating oil composition containing both a zinc dialkyl dithiophosphate and a dicarboxylic acid/glycol ester (Compositions II and III), Composition I (without ester) and Composition III were given a standard engine test, i.e. Sequence III C Test to determine valve train wear as shown in the following table:

| | Sequence III C Test Cam and Lifter Wear | |
|---|---|---|
| | Max. in. $\times 10^{-4}$ | Ave. in. $\times 10^{-4}$ |
| Composition I | 11 | 8 |
| Composition III | 7 | 4 |

The composition containing both the zinc dialkyl dithiophosphate and a dicarboxylic acid/glycol ester (i.e. Composition III) showed highly satisfactory results and this was particularly surprising in view of the expected displacement of some of the zinc component, an exceptional extreme pressure agent, by the ester.

What is claimed is:

1. A storage stable lubricating oil composition comprising a major portion of lubricating oil, from about 0.01 to about 5.0 parts by weight of zinc dihydrocarbyl dithiophosphate, from about 0.01 to about 1.0 parts by weight of an ester of a polycarboxylic acid with a glycol and from about 0.1 to about 30 parts by weight of an ashless dispersant containing a high molecular weight aliphatic hydrocarbon oil solubilizing group attached thereto, all weights based on 100 parts by weight of said lubricating oil.

2. The composition of claim 1 wherein said ashless dispersant is derived from an alkenyl succinic acid/anhydride with said alkenyl group having a molecular weight of at least about 900.

3. The composition of claim 2 wherein said ashless dispersant is a nitrogen containing alkenyl succinic acid-/anhydride or ester of said alkenyl succinic acid/anhydride derived from monohydric and polyhydric alcohols, phenols and naphthols.

4. The composition of claim 3 wherein the dihydrocarbyl groups of said zinc compound are alkyl groups of 2 to 8 carbon atoms.

5. The composition of claim 4 wherein said ester is formed from a dicarboxylic acid having from about 9 to about 42 carbon atoms between carboxylic acid groups and a glycol which is selected from the group consisting of alkane diols having from about 2 to about 12 carbon atoms or an oxa-alkane diol having from about 4 to about 200 carbon atoms.

6. The composition of claim 5 wherein said ashless dispersant is derived from an amine compound having one of the formulas:

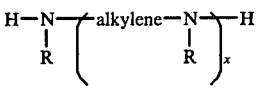

(i)

wherein $x$ is an integer of 1 to 10, R is hydrogen or a hydrocarbon of 1 to 7 carbon atoms and the alkylene is a straight or branched chain alkylene radical of up to 7 carbon atoms;

(ii) $NH_2$ - alkylene $(O\text{-alkylene})_m NH_2$ where $m$ has a value of about 3 to about 70, (iii) $R\{alkylene(O\text{-}alkylene)_n NH_2\}_{3\text{-}6}$ where $n$ has a value of about 1 to about 40 with the proviso that the sum of all the $n$'s is from about 3 to about 70 and R is a polyvalent saturated hydrocarbon radical of up to 10 carbon atoms having a valence of 3 to 6; and (iv) R - $NH_2$ where R is a monovalent organic radical having up to 20 carbon atoms and from 0 to about 6 alcoholic hydroxyl groups.

7. The composition of claim 6 wherein said dicarboxylic acid is a dimer of a conjugated fatty acid having from about 16 to about 22 carbon atoms between carboxylic acid groups.

8. The composition of claim 7 wherein said ashless dispersant is derived from polyisobutenyl succinic anhydride.

9. The composition of claim 8 wherein said ashless dispersant is derived from an amine and polyisobutenyl succinic anhydride in amounts of from about 0.3:1 to about 20:1 moles of anhydride to amine and wherein the nitrogen content of the prepared amine derived dispersant is less than about 2 percent by weight.

10. The composition of claim 9 wherein said ashless dispersant is the reaction product of polyisobutenyl succinic anhydride and at least one compound selected from the group consisting of polyethylene amines, polyoxyethylene and polyoxypropylene amines and pentaerythritol.

11. The composition of claim 10 wherein said ashless dispersant is the reaction product of polyisobutenyl succinic anhydride and at least one compound selected from the group consisting of tetraethylene pentamine, polyethylene diamine, polyoxypropylene diamine, trismethylolaminomethane and pentaerythritol.

12. The composition of claim 1 prepared by predispersing either said zinc dihydrocarbyl dithiophosphate or said ester of polycarboxylic acid/glycol or both separately in said ashless dispersant prior to combining them in the lubricating oil composition.

13. The composition of claim 5 prepared by predispersing either said zinc dihydrocarbyl dithiophosphate or said ester of polycarboxylic acid/glycol or both separately in said ashless dispersant prior to combining them in the lubricating oil composition.

14. The composition of claim 8 prepared by predispersing either said zinc dihydrocarbyl dithiophosphate or said ester of polycarboxylic acid/glycol or both separately in said ashless dispersant prior to combining them in the lubricating oil composition.

15. The composition of claim 11 prepared by predispersing either said zinc dihydrocarbyl dithiophosphate or said ester of polycarboxylic acid/glycol or both separately in said ashless dispersant prior to combining them in the lubricating oil composition.

16. The process of preparing the storage stable lubricating oil composition of claim 1 wherein said zinc component or said ester component or both separately are predispersed in said ashless dispersant prior to combining them in the lubricating oil composition.

17. The process of preparing the storage stable lubricating oil composition of claim 5 wherein said zinc component or said ester component or both separately are predispersed in said ashless dispersant prior to combining them in the lubricating oil composition.

18. The process of preparing the storage stable lubricating oil composition of claim 8 wherein said zinc component or said ester component or both separately are predispersed in said ashless dispersant prior to combining them in the lubricating oil composition.

19. The process of preparing the storage stable lubricating oil composition of claim 11 wherein said zinc component or said ester component or both separately are predispersed in said ashless dispersant prior to combining them in the lubricating oil composition.

* * * * *